US010702038B2

(12) United States Patent
Mitchell

(10) Patent No.: US 10,702,038 B2
(45) Date of Patent: Jul. 7, 2020

(54) METHOD FOR REMOVAL OF ARTIFICIAL FINGERNAILS

(71) Applicant: Sunja Mitchell, Congers, NY (US)

(72) Inventor: Sunja Mitchell, Congers, NY (US)

(73) Assignee: Marmalade Cosmetics LLC, Valley Cottage, NY (US)

( * ) Notice: Subject to any disclaimer, the term of this patent is extended or adjusted under 35 U.S.C. 154(b) by 282 days.

(21) Appl. No.: 15/790,266

(22) Filed: Oct. 23, 2017

(65) Prior Publication Data

US 2019/0116956 A1 Apr. 25, 2019

(51) Int. Cl.

| | |
|---|---|
| ***A45D 29/00*** | (2006.01) |
| ***B08B 3/08*** | (2006.01) |
| ***B08B 1/00*** | (2006.01) |
| ***B08B 3/10*** | (2006.01) |
| ***A45D 29/17*** | (2006.01) |
| *A45D 31/00* | (2006.01) |

(52) U.S. Cl.

CPC ..... *A45D 29/007* (2013.01); *A45D 29/17* (2013.01); *B08B 1/001* (2013.01); *B08B 3/08* (2013.01); *B08B 3/10* (2013.01); *A45D 29/00* (2013.01); *A45D 31/00* (2013.01)

(58) Field of Classification Search

CPC ..... A45D 29/007; A45D 29/00; A45D 29/16; A45D 29/17; A45D 31/00; B08B 1/001; B08B 3/08; B08B 3/10; B08B 1/005

USPC ..... 132/200, 73, 73.5, 75.3, 104, 132; D8/16, 18, 19, 105, 89; 30/26, 169, 30/346.5, 357; D28/56, 57, 58, 61, 62; 15/105, 105.5, 235.3, 235.4, 235.7

See application file for complete search history.

(56) References Cited

U.S. PATENT DOCUMENTS

| | | | | |
|---|---|---|---|---|
| D182,315 S * | 3/1958 | Tupper et al. | ..... | A45D 31/00 D28/57 |
| 3,966,335 A | 6/1976 | Abramson | | |
| 4,140,139 A | 2/1979 | Aylott | | |
| 4,459,987 A | 7/1984 | Pangburn | | |
| 4,930,529 A * | 6/1990 | Whitney | ..... | A45D 29/16 132/73 |
| D362,604 S * | 9/1995 | White | ..... | D8/19 |

(Continued)

FOREIGN PATENT DOCUMENTS

| | | | | |
|---|---|---|---|---|
| JP | 10-201528 A * | 1/1997 | ..... | A45D 29/14 |
| JP | 10201528 A * | 8/1998 | ..... | A45D 29/14 |

OTHER PUBLICATIONS wikiHow, How to Remove Press-On Nails, (Sep. 14, 2017), https://web.archive.org/web/20170914170758/https://www.wikihow.com/Remove-Press%E2%80%90On-Nails# (Year: 2017).*

(Continued)

*Primary Examiner* — Tatiana L Nobrega
*Assistant Examiner* — Samuel A Raque
(74) *Attorney, Agent, or Firm* — Thomas J. Germinario

(57) ABSTRACT

A method for removing an artificial fingernail from an underlying natural fingernail to which it is attached by an adhesive has the steps of: (a) soaking the fingertips in warm, soapy water; (b) providing a prying tool comprising a thin, smooth sheet of semi-rigid material; (c) inserting the prying tool between the artificial and the underlying natural fingernails; (d) lifting the artificial fingernail away from the underlying natural fingernail; and (e) manually removing the artificial fingernail from the fingertip.

1 Claim, 3 Drawing Sheets

(56) References Cited

U.S. PATENT DOCUMENTS

| | | | | |
|---|---|---|---|---|
| 5,609,166 | A | 3/1997 | Walker | |
| 5,806,536 | A | 9/1998 | Tietjen | |
| 5,823,203 | A | 10/1998 | Carroll et al. | |
| D402,514 | S * | 12/1998 | Killins | D8/16 |
| 5,921,250 | A | 7/1999 | Rhea et al. | |
| 6,206,010 | B1 * | 3/2001 | Malki | A45D 24/00 132/102 |
| 6,311,580 | B1 * | 11/2001 | Nagy | B67B 7/403 81/3.09 |
| 6,354,174 | B1 * | 3/2002 | Korwin | B60J 7/104 7/169 |
| 6,367,485 | B1 | 4/2002 | Dutton-Davis et al. | |
| 7,146,986 | B2 | 12/2006 | Ide | |
| D799,301 | S * | 10/2017 | Cetera | D8/105 |
| 2002/0148479 | A1 * | 10/2002 | Willis | A45D 29/17 132/75.3 |
| 2005/0155618 | A1 * | 7/2005 | Lafferty | A45C 11/24 132/104 |
| 2008/0041404 | A1 * | 2/2008 | Vo | A45D 31/00 132/73 |
| 2017/0011720 | A1 * | 1/2017 | Pascale | G10D 3/163 |

OTHER PUBLICATIONS

Brielle Yang, What Are the Dimensions of a Credit Card? [Thickness & Size], (Aug. 8, 2016), https://blog.4colorprint.com/dimensions-of-a-credit-card (Year: 2016).* wikiHow, How to Remove Press-On Nails, (Sep. 14, 2017), https://web.archive.org/web/20170914170758/https://www.wikihow.com/Remove-Press%E2%80%90On-Nails# (Year: 2017) (Year: 2017).*

RemoveAcrylicNails (http://web.archive.org/web/20161018104341/http://manicure.wonderhowto.com/how-to/remove-acrylic-nails-with-soak-348833/) (Year: 2017).*

EcoNuts; https://econutssoap.com/blogs/eco-nuts-knowledge-base/laundry-science-101-hot-water-vs-cold-water (Year: 2016).*

* cited by examiner

METHOD FOR REMOVAL OF ARTIFICIAL FINGERNAILS

FIELD OF INVENTION

The present invention relates to the general field of artificial fingernails and fingernail extensions, and more particularly to a method for removing artificial acrylic fingernails.

BACKGROUND OF THE INVENTION

Artificial fingernails and fingernail extensions (collectively referred to hereinafter as "artificial fingernails") are widely used by women as cosmetic enhancements. They may be applied by salon professionals or by consumers using a kit. The application of artificial fingernails typically involves gluing the artificial fingernail to the natural fingernail below it. Eventually, such artificial fingernails need to be removed, either because they become damaged or because the wearer needs to engage in manual activities with which such the fingernails would interfere.

Existing removal methods have several disadvantages, however. Many of these methods involve prolonged soaking in strong solvents, such as acetone, to dissolve the adhesive, and/or mechanically abrading the plastic fingernail to disintegrate it. In both cases, damage and/or irritation to wearer's fingertips is a hazard.

The method of the present invention, on the other hand, employs the leverage of a special tool to pry off the artificial fingernail after its adhesive bond has been loosened by soaking in warm, soapy water, thereby avoiding the hazards of existing methods.

SUMMARY OF THE INVENTION

The present invention is a method for removing from a fingertip an artificial fingernail, which is attached to an underlying natural fingernail by an adhesive. The method comprises the steps of: (a) soaking the fingertip for 15 to 30 minutes in a saturated water solution of a soap or a mild detergent, warmed to between 95° and 120° F., so as to soften and loosen the adhesive; (b) inserting a prying tool between the artificial fingernail and the underlying natural fingernail; (c) with the prying tool, lifting the artificial fingernail away from the underlying natural fingernail; and (d) removing the artificial fingernail from the fingertip.

The prying tool comprises a thin, flat sheet of a semi-rigid material, such as polyvinyl chloride, polyethylene or polypropylene, having a thickness of 10 to 20 mils and a width and length of 1.5 to 2.5 inches. The sheet has a smooth surface, so that it can readily slide under an artificial fingernail. The prying tool has one or more vertices, at least one of which must form an acute or right angle, and it has a size and shape that can be gripped between a user's thumb and index finger.

One or more of the vertices of the prying tool can be pointed, to better penetrate the adhesive layer during initial insertion beneath the artificial fingernail, while one or more other vertices can be rounded in order to exert leverage over a larger area once the adhesive layer has been breached. Preferably, one or more of the vertices of the prying tool form a projecting finger having a substantially isosceles or equilateral triangular shape and an apex angle between 45° and 60°. When inserted under the artificial fingernail, the projecting finger flexes downward so as to exert an upward lifting pressure on the artificial fingernail. Optionally, the prying tool can also have one or more arcuate indents configured to conform to the curvature of the fingertip and the projecting edge of the artificial fingernail. One of the indents is inserted between the fingertip and the artificial fingernail with upward pressure exerted to lift the artificial fingernail.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
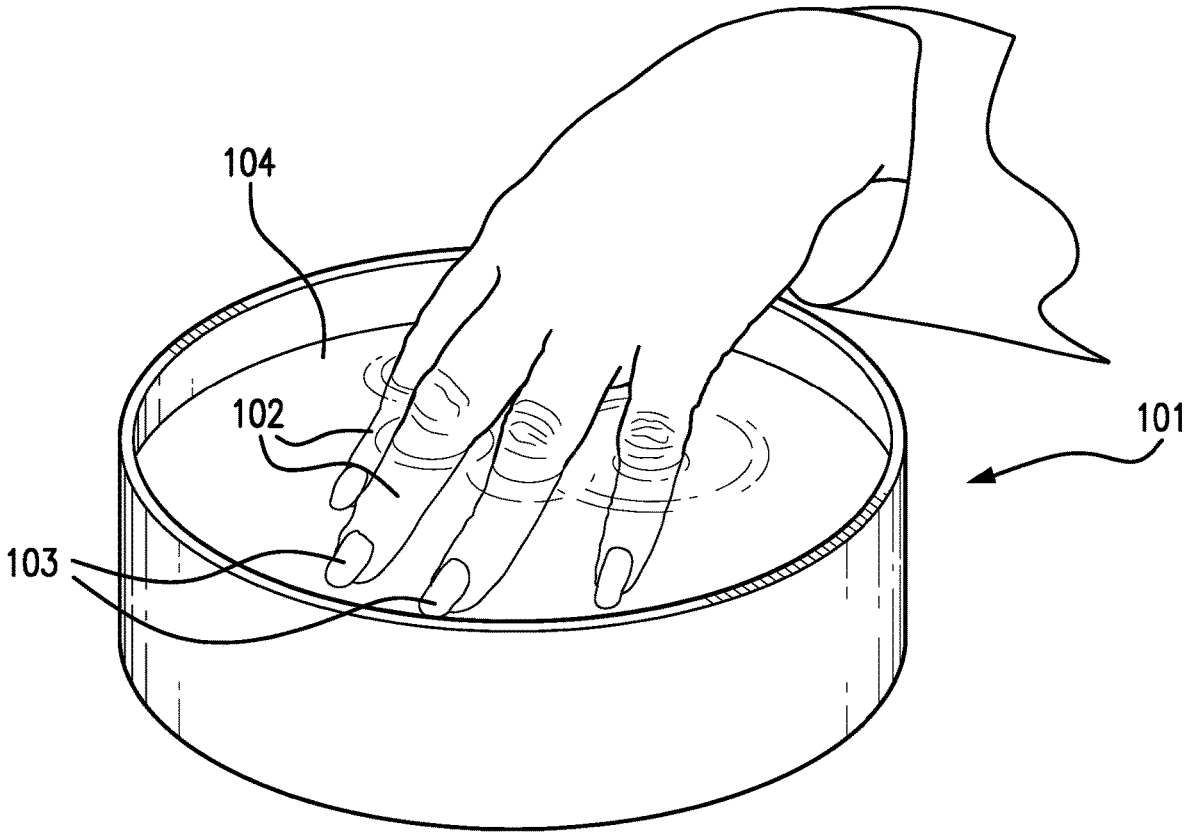
FIG. 1 is a perspective view of the step of soaking the fingertips in warm, soapy water to soften and loosen adhesive under the artificial fingernails, according to one embodiment of the present invention.

Referring to FIG. 1, the first step 101 of the method of one embodiment of the present invention comprises soaking the fingertips 102 having artificial fingernails 103 for 15 to 20 minutes in a saturated water solution 104 of a soap or a mild detergent, such as a dish or hand detergent. The soaking solution 104 is warmed to a temperature between 95° and 120° F., so as to soften and loosen the adhesive binding the artificial fingernail 103 to the underlying natural fingernail.

Figure 2:
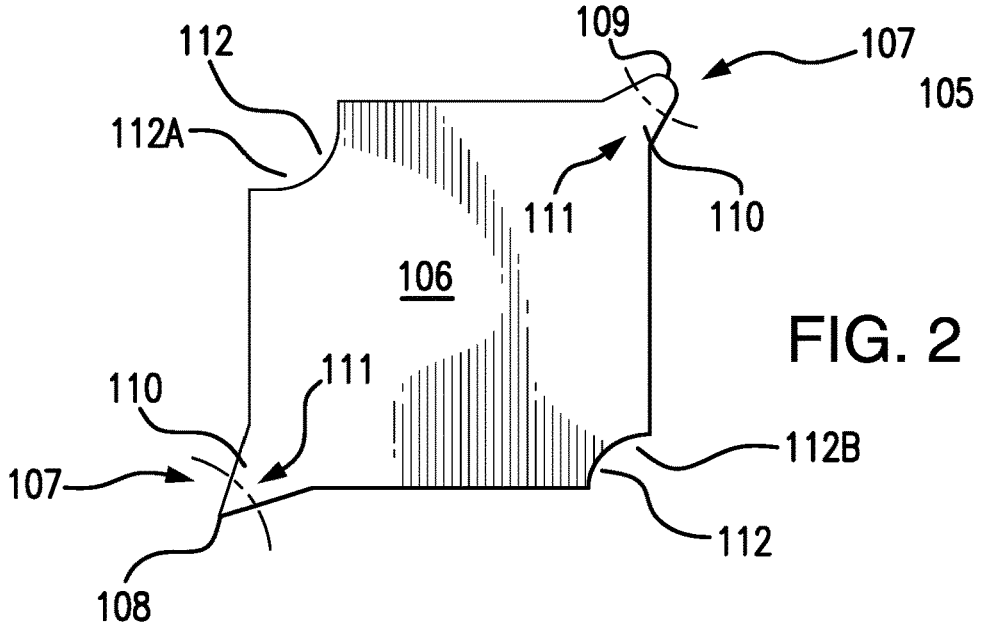
FIG. 2 is a plan view of a prying tool used in one embodiment of the present invention.
Figure 3:
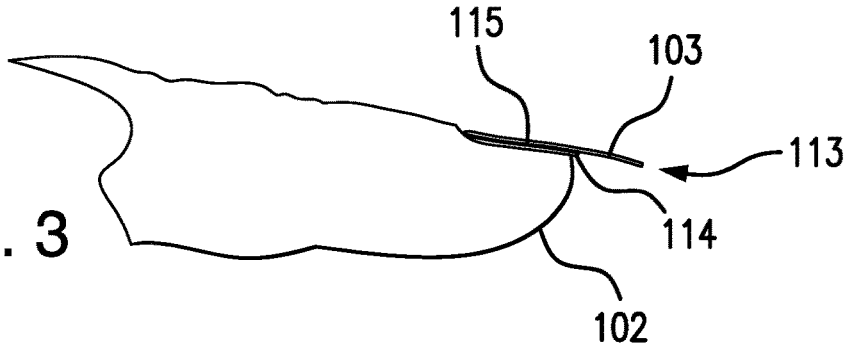
FIG. 3 is a side profile view of a fingertip having an artificial fingernail glued by an adhesive to an underlying natural fingernail.

Referring to FIG. 2, the second step 105 of one embodiment of the present invention comprises providing a prying tool 106. In this embodiment, the prying tool 106 is a substantially square 1¾"×1¾" sheet of semi-rigid, smooth, clear polyvinyl chloride with a thickness of 15 mils. This exemplary prying tool 106 has two acute-angled vertices 107, one of which forms a pointed apex 108, and one of which forms a rounded apex 109. In this embodiment, both acute-angled vertices 107 form projecting fingers 110 having a substantially equilateral triangular shape and an apex angle 111 of 60°. This exemplary prying 106 tool also has two arcuate concave indents 112, the curvature of which conform to that of the fingertip 102 and the forward projecting edge 113 of the artificial fingernail 103, as best seen in FIG. 3. In this embodiment of the present invention, one of the concave indents 112 is deeper 112A and the other is shallower 112B, such that the deeper indent depth is greater than ¼ inch and the shallow indent depth is less than ¼ inch.

Figure 4:
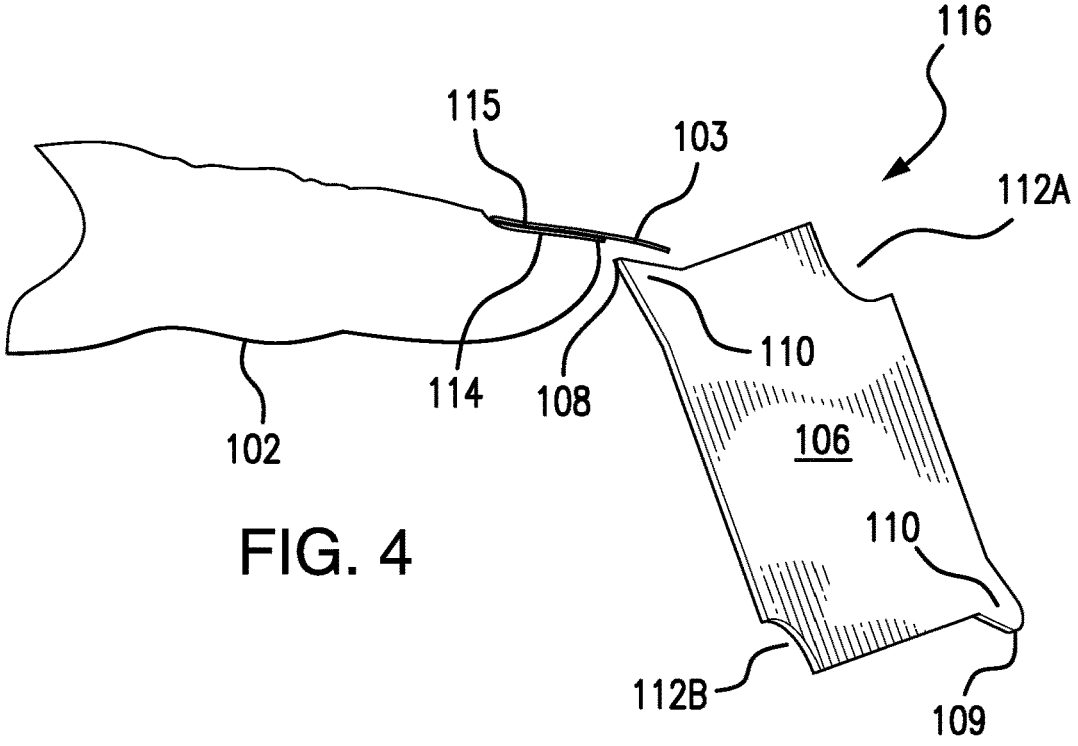
FIG. 4 is a perspective view of a prying tool being inserted under an artificial fingernail, according to one embodiment of the present invention.

Referring now to FIG. 3, an exemplary fingertip 102 has a natural fingernail 114, to which a layer of adhesive 115 has been applied to attach an artificial fingernail 103 having a forward projecting edge 113. FIG. 4 illustrates the third step 116 of one embodiment of the present invention, in which the prying tool 106 is inserted between the artificial fingernail 103 and the underlying natural fingernail 114. One acute angled vertex 107 of the prying tool 106, preferably the one with the pointed apex 108, is inserted into the adhesive layer 115, so as to initiate separation between the adhesive layer 115 and the artificial fingernail 103.

Figure 5:
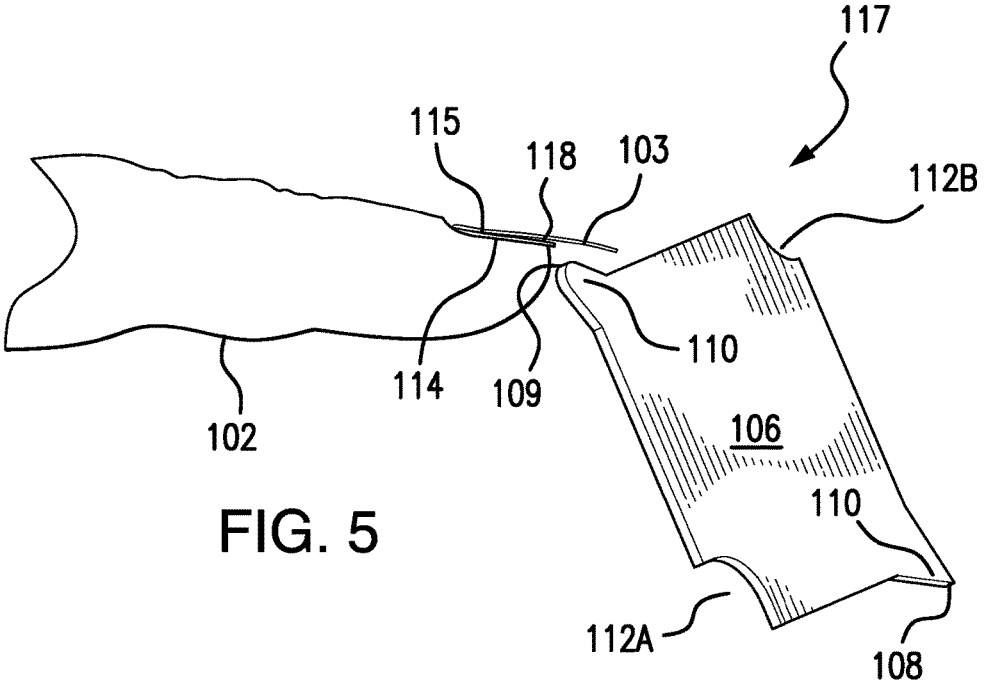
FIG. 5 is a perspective view of a prying tool being inserted under an artificial fingernail which is separating from an underlying adhesive layer, according to one embodiment of the present invention.

FIG. 5 illustrates the fourth step 117 of this exemplary method. Once a separation 118 is initiated between the artificial fingernail 103 and the adhesive layer 115, one acute-angled vertex 107 of the prying tool 106, preferably the one with the rounded apex 109 is inserted into the separation 118 as used to lift the artificial fingernail 103 away from the underlying natural fingernail 114. In this step 117, the flexing of the projecting finger 110 exerts an upward lifting force on the artificial fingernail 103.

In one embodiment of the present invention, as shown in FIG. 4 and FIG. 5, the two acute-angled vertices 107 of the prying tool 106 which form triangular projecting fingers 110 are first inserted into the adhesive layer 115, with the pointed apex 108 being inserted first in order to penetrate the adhesive 115, and the rounded apex 109 inserted next to spread the incipient fissures in the adhesive layer 115. The flexing of these projecting fingers 110 exerts an upward lifting pressure on the artificial fingernail 103.

In one embodiment of the present invention, the insertion of the two arcuate-angled vertices 107 of the prying tool 106, as described above, is followed by the insertion beneath the artificial fingernail 103 of the two arcuate concave indents 112 of the prying tool 106, in order to exert pressure across the entire curved width between the fingertip 102 and the artificial fingernail 103. Preferably, the shallower concave indent 112B is inserted first, and then the deeper concave indent 112A is inserted to broaden the area of pressure and incipient separation between the artificial fingernail 103 and the underlying natural fingernail 114.

Figure 6:
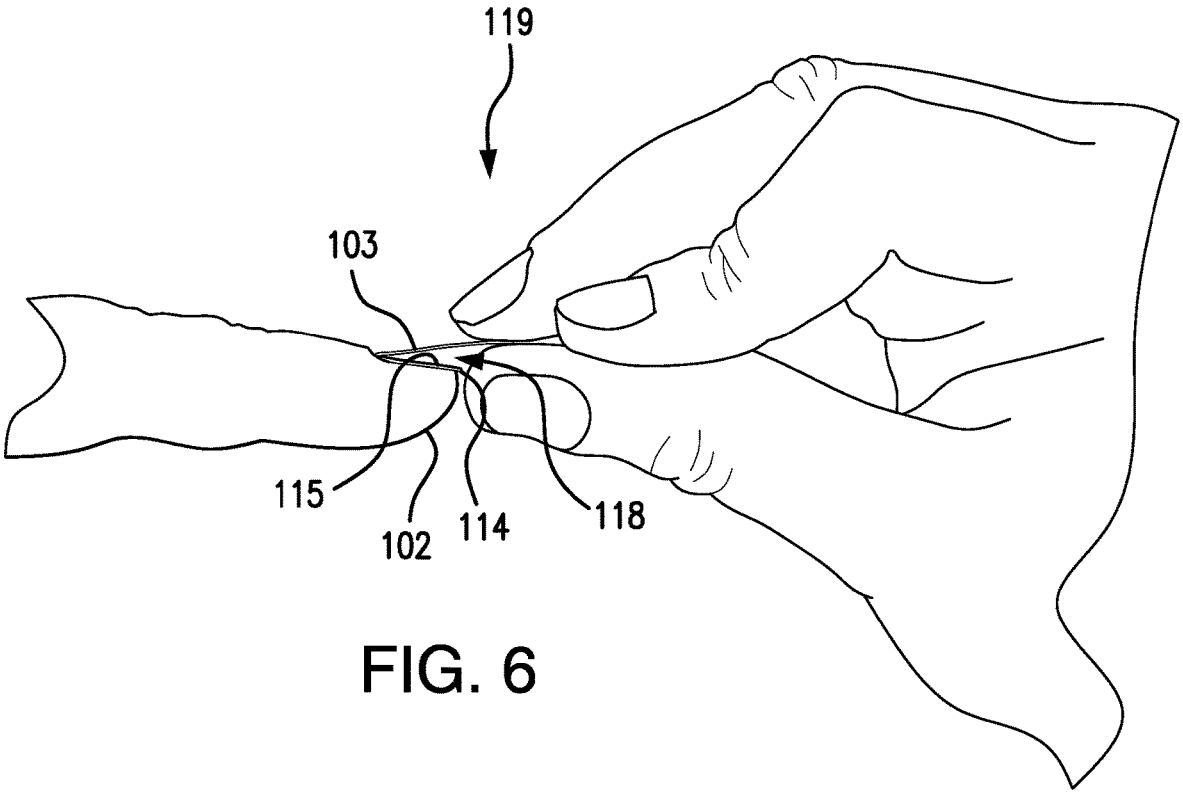
FIG. 6 is a perspective view of an artificial fingernail being manually removed from a fingertip, according to one embodiment of the present invention.

Once there is separation between the artificial fingernail 103 and the underlying natural fingernail 114, either of the acute vertices 107 of the prying tool 106, preferably the one with the rounded apex 109, can be used to lift the artificial fingernail 103 away from the underlying natural fingernail 114—which is the fourth step 117 of the method—allowing the artificial fingernail 103 to then be manually removed from the fingertip 102—which is the fifth and final step 119 as depicted in FIG. 6.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method for removing from a fingertip an artificial fingernail, which is attached to an underlying natural fingernail by an adhesive layer, the method comprising:

(a) immersing the fingertip in a soaking liquid, comprising a saturated water solution of a soap or a mild detergent, for 15 to 30 minutes, wherein the soaking liquid is pre-heated to a temperature of 95° to 120° F., so as to soften and loosen the adhesive layer;

(b) providing a prying tool, comprising a flat, smooth sheet of a semi-rigid material, defining a prying tool plane and having a thickness of 10 to 15 mils and a length and a width of 1.5 to 2.5 inches, and having two acute vertices, each of which forms a substantially isosceles or equilateral triangular shape with an acute apex angle, wherein one of the two acute vertices is a first acute vertex which forms a pointed apex and one of the two acute vertices is a second acute vertex which forms a rounded apex, such that each of the two acute vertices is insertable beneath the artificial fingernail into the adhesive layer, and wherein the prying tool has two arcuate concave indents, and wherein one of the two arcuate concave indents is a deeper indent and another of the two arcuate concave indents is a shallower indent, and wherein each of the two arcuate concave indents has a planar concave curvature, all points of which are within the prying tool plane, and which substantially conjugately conforms to a convex curvature of the fingertip and to a convex curvature of a projecting forward edge of the artificial fingernail, such that each of the two arcuate concave indents is insertable between the fingertip and the artificial fingernail;

(c) sequentially inserting each of the two acute vertices into the adhesive layer, wherein the first acute vertex is first inserted into the adhesive layer in order to penetrate the adhesive layer and create incipient fissures in the adhesive layer, so as to initiate a separation between the adhesive layer and the artificial fingernail, and wherein the second acute vertex is next inserted into the adhesive layer in order to spread and widen the incipient fissures, so as to expand the separation between the adhesive layer and the artificial fingernail, and wherein, and after the rounded apex is inserted, the shallower indent is inserted with upward pressure between the fingertip and the artificial fingernail, so as to increase the separation between the adhesive layer and the artificial fingernail, and then the deeper indent is inserted between the adhesive layer and the artificial fingernail, so as to broaden the separation between the adhesive layer and the artificial fingernail;

(d) using the prying tool and at least one of the two acute vertices to lift the artificial fingernail away from the underlying natural fingernail; and (e) manually removing the artificial fingernail from the fingertip.

* * * * *